US006840743B2

(12) United States Patent
Herke et al.

(10) Patent No.: US 6,840,743 B2
(45) Date of Patent: Jan. 11, 2005

(54) PLURAL FAN INSTALLATION FOR A COOLING SYSTEM FOR A MOTOR VEHICLE, WITH A CONTROL UNIT, FOR CONTROLLING PLURAL FAN MOTORS, MOUNTED WITHIN ONE MOTOR HOUSING

(75) Inventors: Dirk Herke, Nuertingen (DE); Thomas Kanamueller, Esslingen (DE)

(73) Assignee: AFL Germany Electronics GmbH, Frickenhausen (DE)

( * ) Notice: Subject to any disclaimer, the term of this patent is extended or adjusted under 35 U.S.C. 154(b) by 8 days.

(21) Appl. No.: 10/174,504

(22) Filed: Jun. 17, 2002

(65) Prior Publication Data

US 2002/0195069 A1 Dec. 26, 2002

Related U.S. Application Data

(63) Continuation of application No. PCT/EP01/09918, filed on Aug. 29, 2001.

(30) Foreign Application Priority Data

Oct. 17, 2000 (DE) ..... 100 52 331

(51) Int. Cl.[7] ..... F04B 41/06

(52) U.S. Cl. ..... 417/2; 417/3; 417/5; 417/366; 417/423.5; 417/423.6; 123/41.56; 123/41.65

(58) Field of Search ..... 417/366, 427.1, 417/423.5, 14, 18, 32, 2, 3, 426, 165, 5; 123/41.56, 41.65

(56) References Cited

U.S. PATENT DOCUMENTS

| | | | | | |
|---|---|---|---|---|---|
| 4,590,892 | A | * | 5/1986 | Nose et al. | 123/41.12 |
| 4,626,723 | A | * | 12/1986 | McMillen | 310/83 |
| 4,779,577 | A | | 10/1988 | Ritter et al. | |
| 4,797,600 | A | * | 1/1989 | Savage et al. | 318/254 |
| 5,478,214 | A | * | 12/1995 | Howarth et al. | 417/423.5 |
| 5,660,149 | A | | 8/1997 | Lakerdas et al. | |
| 5,763,969 | A | * | 6/1998 | Metheny et al. | 310/62 |
| 5,947,189 | A | * | 9/1999 | Takeuchi et al. | 165/51 |
| 5,963,887 | A | * | 10/1999 | Giorgio | 702/64 |
| 5,984,649 | A | * | 11/1999 | Kato et al. | 417/423.5 |
| 5,990,590 | A | * | 11/1999 | Roesel et al. | 310/113 |
| 6,155,335 | A | * | 12/2000 | Acre et al. | 165/41 |
| 6,257,832 | B1 | * | 7/2001 | Lyszkowski et al. | 417/2 |
| 6,400,113 | B1 | * | 6/2002 | Garcia et al. | 318/463 |
| 6,428,282 | B1 | * | 8/2002 | Langley | 417/2 |
| 6,626,653 | B2 | * | 9/2003 | Lin et al. | 417/423.5 |
| 2003/0053913 | A1 | * | 3/2003 | Sekiguchi | 417/3 |

FOREIGN PATENT DOCUMENTS

| | | | |
|---|---|---|---|
| DE | 36 25 375 | 2/1988 | |
| DE | 44 10 512 | 10/1995 | |
| DE | 199 29 194 | 1/2000 | |
| EP | 0 979 745 | 2/2000 | |
| FR | 2 639 687 | 6/1990 | |
| JP | 10294581 | * 11/1998 | H05K/07/20 |

* cited by examiner

*Primary Examiner*—Justine R. Yu
*Assistant Examiner*—Emmanuel Sayoc
(74) *Attorney, Agent, or Firm*—Barry R. Lipsitz; Douglas M. McAllister

(57) ABSTRACT

The present invention provides a fan installation for a cooling system of a motor vehicle, comprising at least two fans which respectively have an electric fan motor arranged in a separate housing and a fan wheel which can be driven by the fan motor. The fan installation also comprises a control unit for operating the fan motors. The invention provides for an improved fan installation with a simple and cost-effective design, which is achieved by arranging the control unit in the housing of one of the fans for operating both fan motors.

21 Claims, 6 Drawing Sheets

PLURAL FAN INSTALLATION FOR A COOLING SYSTEM FOR A MOTOR VEHICLE, WITH A CONTROL UNIT, FOR CONTROLLING PLURAL FAN MOTORS, MOUNTED WITHIN ONE MOTOR HOUSING

This application is a continuation of International application number PCT/EP01/09918 filed on Aug. 29, 2001.

The present disclosure relates to the subject matter disclosed in international application No. PCT/EP01/09918 of Aug. 29, 2001, which is incorporated herein by reference in its entirety and for all purposes.

BACKGROUND OF THE INVENTION

The invention relates to a fan installation for a cooling system of a motor vehicle, comprising at least two fans which respectively have an electric motor disposed in a separate housing and a fan wheel which can be driven by said motor, and comprising a control unit for operating the fan motors.

Fan installations of this type are known from the prior art. They are normally used to supply large-area radiators in a motor vehicle with the necessary cooling air, in particular when an increased cooling performance is required.

In fan installations of this type, the fans are normally disposed in front of or behind the radiator, in order to produce the air flow through the radiator. Furthermore, the fans are driven by one or two control units which are disposed separately in the engine compartment.

The invention is based on the object of improving a fan installation of the generic type in such a way that this is constructed as simply as possible and as cost-effectively as possible.

SUMMARY OF THE INVENTION

According to the invention, in a fan installation of the type described at the beginning, this object is achieved in that the control unit is disposed in the housing of one of the fans and operates both the fan motor disposed in this housing and the fan motor of the other fan.

The advantage of the solution according to the invention is to be seen in the fact that with this solution the control device to be disposed separately in the engine compartment is dispensed with, and therefore one device fewer has to be mounted in the engine compartment, so that in particular in the case of restricted spatial conditions, there is a gain with regard to the space required.

Furthermore, by disposing the control unit in the housing of one of the fans, the number of lines may also be simplified, since only one feed line for feeding the fan system has to be laid to one fan, and a supply line from this fan to the other fan.

Furthermore, a further advantage of the solution according to the invention is to be seen in the fact that with the disposal of the control unit in the housing of one of the fans, defined conditions for the cooling of the control unit can also be achieved in a simple way, so that all the problems relating to the cooling of an additional control device disposed separately in the engine compartment are dispensed with.

In addition, the control unit may advantageously be integrated into the housing of the one fan, without the volume of the latter increasing to a noticeable extent, so that a considerable gain in space in the engine compartment of the motor vehicle can therefore be achieved.

Finally, by means of the integration of the control unit into the housing of the one fan, an improvement with regard to electromagnetic compatibility can additionally be achieved, since all the components which may be responsible for interference in the vehicle electrical system, such as fan motors and control unit, are combined as compactly as possible and can therefore be shielded better and therefore, overall, have a lower interference potential in the motor vehicle.

A particularly advantageous solution provides for the fan installation to comprise a harness which can be connected to both fans and has a plug-in connection comprising a supply connection and an external connection.

By means of this one harness, it is therefore possible for the total of three cables in the case of the solution known hitherto to be replaced by two connectors in each case, so that a considerable simplification is already possible on the part of the supply lines.

It is particularly advantageous in this case if the harness can be connected to each of the fans via a plug-in connection.

The harness is preferably constructed in such a way that it comprises a connecting line running between the fans and having a feed line.

In principle, a single feed line would be sufficient if a good ground connection is possible between the fans via the usual installation situation in the motor vehicle.

However, in order to obtain the most advantageous electrical solution possible with regard to interference removal, provision is preferably made for the connecting line also to have a ground line in order advantageously to achieve the best possible ground connection between the control unit and the fan motor which is not disposed in the same housing as the control unit.

Furthermore, it is particularly advantageous if the harness has a supply line which runs from the fan provided with the control unit to the plug-in connection and comprises a feed line and an input line.

In principle, it would likewise be unnecessary here to provide a separate ground line. With regard to interference immunity. However, it is likewise beneficial if the supply line has a ground line.

A particularly simple solution provides for the supply line and the connecting line to form a coherent harness and therefore for it to be possible for both lines to be connected, via a common plug-in connection, to the fan provided with the control unit and, via a further plug-in connection, to the other fan, so that overall a harness of this type for the fan installation according to the invention has to have a total of only three plug-in connections, namely the common plug-in connection and in each case one plug-in connection for producing the connection to each of the fans, it being possible for a connection with the control unit to be produced at the same time in the case of the fan provided with the control unit.

With regard to the construction of the control unit, no specific statements were made in connection with the previous explanation of the fan installation according to the invention. For example, a particularly simple and therefore cost-effective solution provides for the control unit to comprise a common output stage for the operation of all the fan motors, so that therefore all the fan motors can be operated via the same output stage, preferably in a parallel circuit.

This solution is extremely cost-effective with regard to the required components, but entails restriction, in particular in the case of monitoring these fan motors and in the case of any separate drive required.

An alternative solution of the fan installation according to the invention therefore provides for the control unit to comprise a dedicated output stage for the operation of each of the fan motors, the output stages of the control unit, corresponding to the number of fan motors, likewise being disposed in the housing of one of the fans and the other fan being supplied via the harness from the end stage provided for said fan and therefore having no kind of control electronics.

With regard to the cooling of the control unit, no specific statements were made in connection with the solutions described hitherto. For example, one advantageous solution provides for the control unit to be coupled thermally to a heat sink and therefore for the heat from the control unit to be dissipated via this heat sink.

The heat preferably arises in this case in the output stage of the control unit, so that it is particularly beneficial if each output stage is coupled thermally with the heat sink.

Preferably carried out in particular are thermal coupling of an electronic switch of the output stage with the heat sink and of a freewheel diode associated with said electronic switch.

With regard to the configuration of the heat sink, no specific statements have been made hitherto. In principle, the cooling of the heat sink itself could be carried out in extremely diverse ways. In particular, however, since the heat sink is arranged on one of the fans, it is particularly beneficial if the heat sink is air-cooled.

For this purpose, the heat sink is expediently provided with a ribbed heat sink, in order to achieve the greatest possible surface for the dissipation of heat to the air flow.

In particular in the case of a plurality of output stages, it is expedient if each of the output stages is coupled to a dedicated ribbed heat sink, so that the heat of each of the output stages can be dissipated in a particularly efficient way.

With regard to the air cooling, it would be conceivable, for example, to arrange the heat sink in such a way that the latter is disposed on an outer side of the housing or projects out of the housing and the air flow that is produced by the fan wheel and passes through the radiator flows against and cools said heat sink.

However, particularly efficient cooling of the heat sink results if an air flow that can be produced by the fan wheel flows through the housing of the fan which is provided with the control unit, and the air flow flows against the heat sink. The control unit according to the invention can therefore be particularly efficiently cooled.

The advantage of this solution is to be seen in the fact that the air flow which flows through the housing and which in particular also serves to cool the fan motor itself can be used for the purpose of cooling the control unit, and therefore cooling of the control unit with an air flow forced in accordance with the power of the fan is possible, so that, as a result, always defined relationships in cooling the control unit are achieved without special measures being required since, in the case of fans of this type, it is usual for the housing to be passed through in any case by a forced air flow for cooling the fan motor, so that in the case of the solution according to the invention, the result is necessarily also specific and defined cooling of the control unit without additional measures being required.

Particularly expedient cooling may be achieved by the heat sink being disposed in the area of an air opening in the housing, through which the air flow passes.

In this case, the air opening is preferably located in a wall region which belongs to the housing and surrounds the control unit.

With regard to the construction of the control unit itself, no specific statements were made in connection with the previous explanation of the individual exemplary embodiments. For example, a particularly advantageous exemplary embodiment provides for the control unit to have a circuit board which extends in a plane running transversely with respect to the axis of rotation of the fan motor. Such a disposition of the circuit board in the housing of the fan has the great advantage that the control unit may be accommodated in a very space-saving manner in said circuit board.

This solution is particularly space-saving if the circuit board bears current feeds for a commutator of the fan motor, so that no independent carrier arrangement for the current feeds for the commutator has to be provided; instead, the latter are situated directly on the circuit board and therefore can also be connected electrically to the circuit board in a simple way.

Current feeds of this type can be constructed in any desired way. It is particularly beneficial if the current feeds comprise carbon brush holders disposed on the circuit board and carbon brushes which can be moved with respect to said holders.

In order to dissipate the heat produced in the region of the current feeds for the commutator as advantageously as possible, provision is preferably made for the current feeds to be thermally coupled with the heat sink.

Further features of the invention are the subject matter of the following description and of the illustrative representation of some exemplary embodiments.

DETAILED DESCRIPTION OF THE INVENTION

Figure 1:
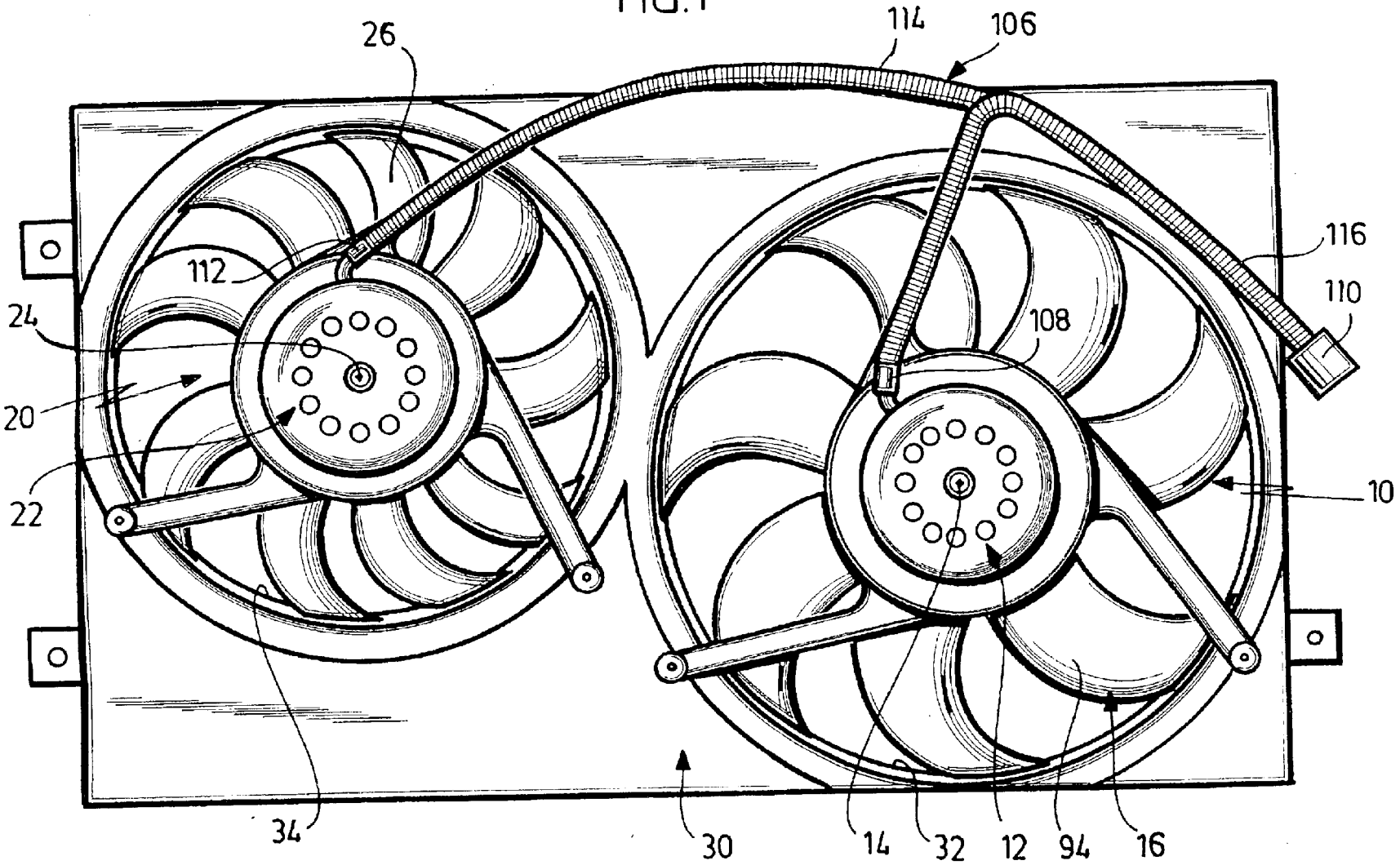
FIG. 1 shows a plan view of a first exemplary embodiment of a fan installation according to the invention.

A first exemplary embodiment, illustrated in FIG. 1, of a fan installation according to the invention for a cooling system, in particular a cooling system of a motor vehicle, comprises a first fan 10 and a second fan 20, which are preferably mounted on a common carrier 30.

The first fan 10 comprises a first housing 12, in which a first fan motor 14 is disposed and is used for the purpose of driving a first fan wheel 16.

The second fan 20 comprises a second housing 22, in which a second fan motor 24 is disposed and is used for the purpose of driving a second fan wheel 26.

The fan installation according to the invention is preferably used for cooling a motor vehicle radiator, preferably one of rectangular shape, which can be covered by the carrier 30, air being blown by the first fan 10 through a first fan opening 32 in the carrier 30, while air is blown by the second fan 20 through a second fan opening 34 in the carrier 30.

Figure 2:
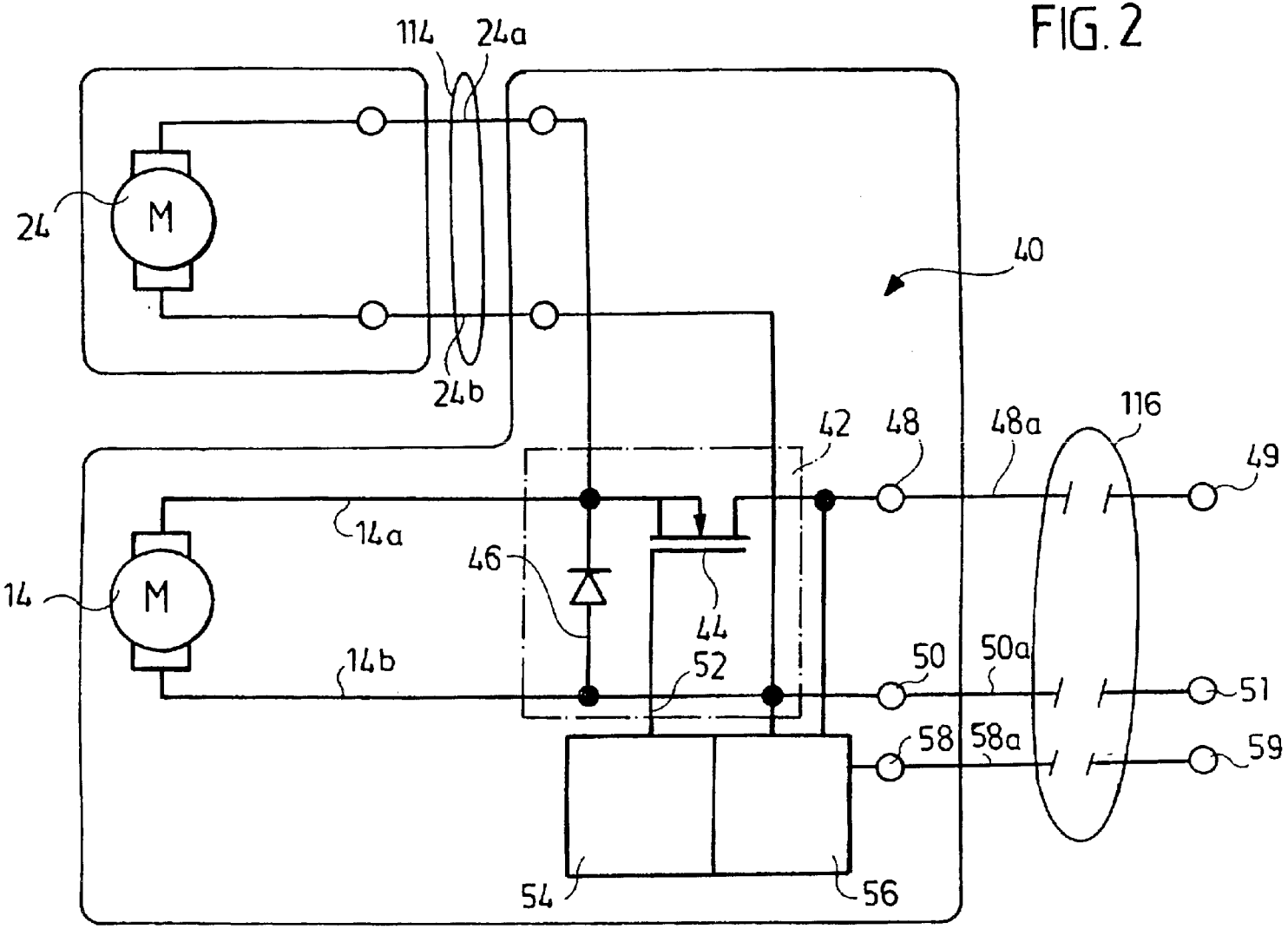
FIG. 2 shows a schematic circuit of the first exemplary embodiment of the fan installation according to the invention.

As illustrated in FIG. 2, the first fan motor 14 and the second fan motor 24 can be operated by a common control unit 40 which, in the case of the first exemplary embodiment, has an output stage 42 which feeds both the first fan motor 14 and the second fan motor 24 connected in parallel thereto.

The output stage 42 has, for example, an electronic switching transistor 44 and a freewheeling diode 46, the electronic switch 44 being located between a feed connection 48 of the control unit 40 and feed lines 14*a* and 24*a* of the fan motors 14 and 24, respectively, and feeding the latter in a cyclic manner, while the freewheeling diode 46 absorbs the current flow caused by the inductance of the fan motors 14 and 24 when the electronic switch 44 is switched off.

The fan motors 14 and 24 are furthermore connected by ground lines 14*b* and 24*b* to a ground connection 50 of the control unit 40.

The electronic switch 44 is driven via a control line 52 by a drive unit 54 which, in turn, can be operated by a logic circuit 56, it being possible for the drive unit 54 to be operated by the logic circuit 56 in such a way that it operates the electronic switch 44 with a pulse-width-modulated signal, the electric power absorbed by the fan motors 14 and 24 being predefineable by means of the pulse width.

In this case, the logic circuit 56 can predefine, via an input line 58*a*, variables on the basis of which the parameters for defining the pulse-width-modulated signal for driving the electronic switch 44 are determined.

Figure 3:
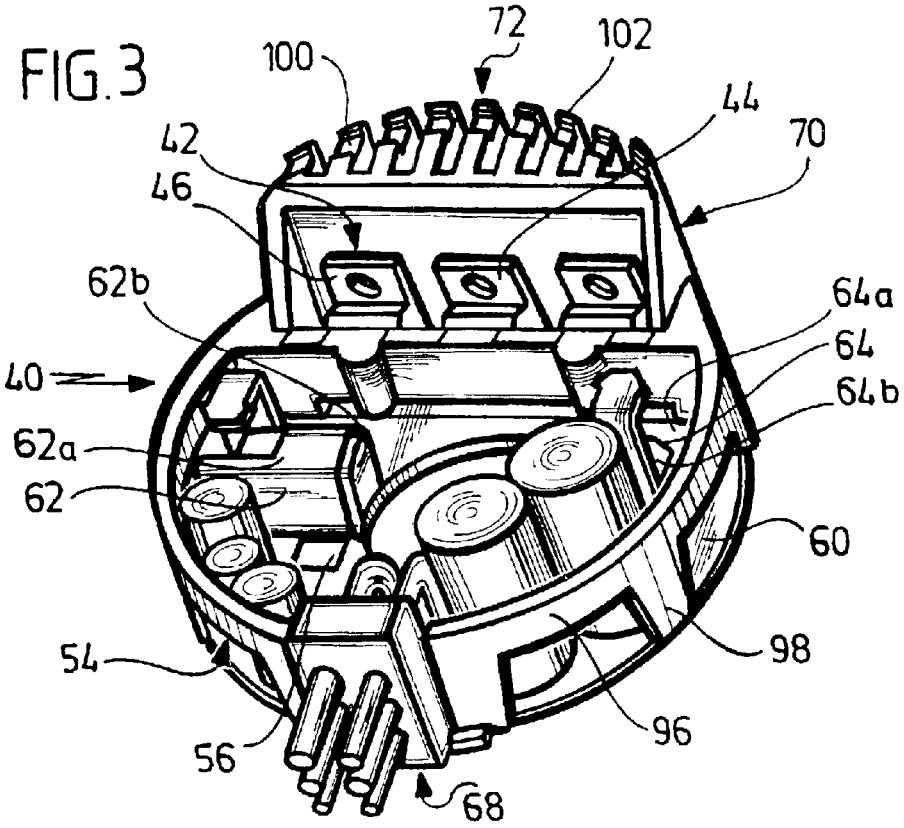
FIG. 3 shows a simplified illustration of a control unit of the first exemplary embodiment of the fan installation according to the invention, comprising circuit board and heat sink.

In the first exemplary embodiment of the fan installation according to the invention, as shown in FIG. 3, the output stage 42 comprising the electronic switch 44 and the freewheeling diode 46 is disposed on a circuit board 60, which can be inserted into the first housing 12 of the first fan 10, the circuit board 60 bearing not only the output stage 42 but, at the same time, the drive unit 54 and the logic circuit 56, so that the entire control unit 40 is disposed in the first housing 12 of the first fan 10.

For the space-saving accommodation of the components of the control unit 40, the circuit board 60 is preferably so disposed in the housing 12 that it extends in a plane 61 which runs transversely with respect to an axis of rotation of the first fan motor 14.

Figure 5:
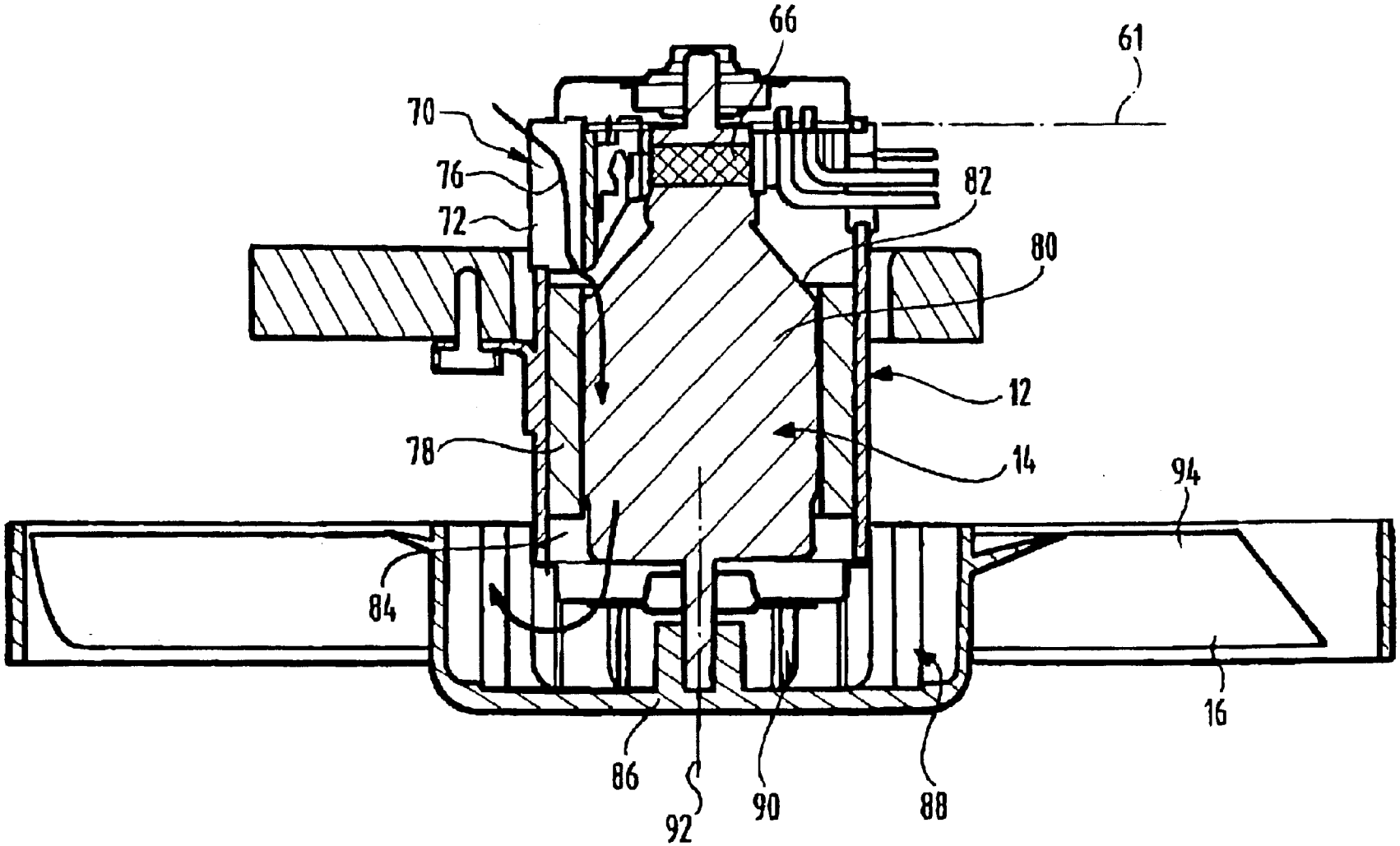
FIG. 5 shows a section along the line 5—5 in FIG. 4 through the fan provided with the control unit.

In order also to configure the design to be as compact as possible, current feeds 62 and 64 for a commutator 66 illustrated in FIG. 5 and belonging to the first fan motor 14 are additionally provided on the circuit board 60.

Also situated on the circuit board 60 is a plug-in connection 68, via which a connection is made both to the feed connection 48 and to the ground connection 50, and also a connection between the output stage 42 and the second fan motor 24, to which the feed line 24*a* and the ground line 24*b* feed, so that no kind of electronic subassembly is provided in the second housing 22 of the second fan 20.

Figure 4:
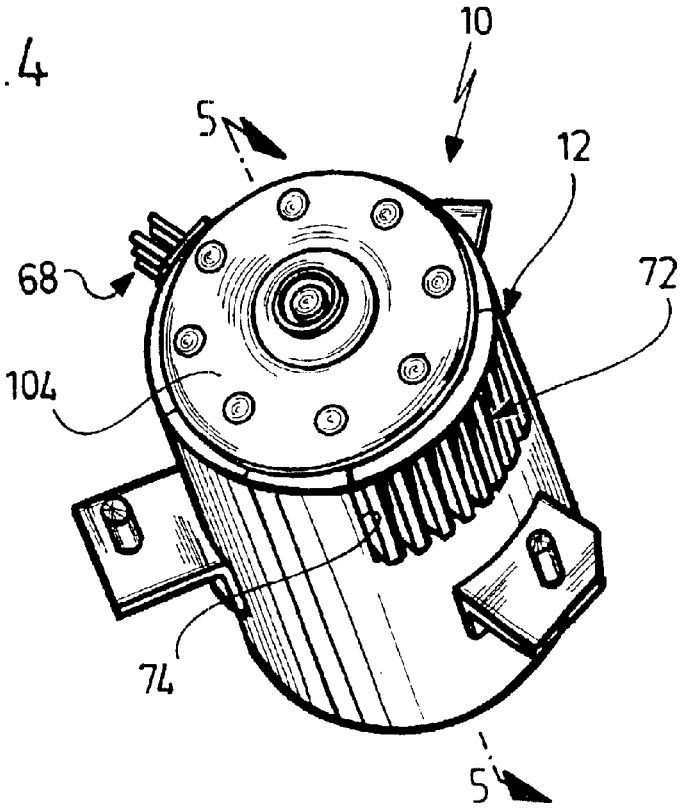
FIG. 4 shows an external view of a housing of a fan provided with the control unit according to FIG. 3.

For the purpose of cooling the control unit 40, as illustrated in FIGS. 3 and 4, a heat sink 70 is provided, with which in particular the electronic switch 44 and the freewheeling diode 46 are thermally coupled. However, thermal coupling to the current feeds 62 and 64 and the heat sink 70 is also preferably further provided.

In particular, each of the current feeds 62, 64 is provided with a carbon brush holder 62*a* and 64*a* disposed in a fixed manner on the circuit board 60, and a carbon brush 62*b*, 64*b* which is disposed such that it can be moved in the respective carbon brush holder 62*a*, 64*a*, which carbon brushes make contact with the commutator.

The heat sink 70 for its part comprises, for example, a ribbed heat sink 72, which is preferably constructed in such a way that it can be cooled by an air flow 76 flowing into the first housing 12 through an air opening 74, the air flow 76 flowing through the ribbed heat sink 72 and preferably also flowing through a stator 78 and a rotor 80 of the first fan motor 14 in order to cool the same.

The air flow 76 preferably flows first through the ribbed heat sink 72, then enters the fan motor 14 in a rear region 82 thereof, flows through the latter and emerges from the first fan motor 14 again from a region 84 thereof on the front side. In so doing, the air flow 76 reaches a fan pot 88 which engages over the front region 84 of the first fan motor 14 with a base 86, the base 86 deflecting the air flow 76 and feeding it to slats 90 belonging to the fan pot 88, which accelerate the air flow 76 in the radial direction toward an axis of rotation 92 of the rotor 80 and, on a side of the fan pot 88 facing away from the base 86, allow it to emerge radially outside the first housing 12.

Thus, in order to produce a negative pressure in the fan pot 88, the fan pot 88 acts on the basis of its slats 90 as a motor fan wheel which forces the air flow 76 and which represents a subarea of the first fan wheel 16, the latter, in particular with vanes 94 disposed outside the fan pot 88, accelerating the air which is intended to pass through the first fan opening 32 of the carrier 30.

The air flow 76 forced through the fan pot 88 is therefore used not only for the purpose of cooling the fan motor 14 in a defined and known way but, at the same time, also for the purpose, via the ribbed heat sink 72, of cooling the heat sink 70 which, for its part, in turn cools the electronic switch 44 and the freewheeling diode 46, which represent the power components of the end stage 42 which produce the most heat.

Furthermore, the heat sink 70 is preferably further provided with a bow 96, which runs from the ribbed heat sink 72 disposed opposite the plug-in connection 68 as far as the plug-in connection 68 and has retaining webs 98 to be supported on the circuit board 60.

The ribbed heat sink 72 and the bow 96 are preferably overall a one-piece part, to which the circuit board 60 is fixed.

In particular, the control unit 14 can be inserted into the first housing in such a way that the ribbed heat sink 72 is located with outer ends 102 of its cooling ribs 100 in the air opening 74 of the first housing 12.

Furthermore, the entire control unit 40 is further covered by a housing cover 104, which closes the entire first housing 12 in the region of an end facing away from the first fan wheel 16 and therefore also spreads over the circuit board 60 of the control unit 40.

The two fans 10 and 20, as illustrated in FIG. 1, are preferably connected to a harness 106 which has a plug-in connector 108 which can be connected to the plug-in connection 12 which preferably projects beyond the housing 68, has a plug-in connector 110 which can be connected to the electrical system of the motor vehicle, and has a plug-in connector 112 with which an electrical connection can be made to the fan motor 24 of the fan 20.

Here, the harness 106 has a connecting line 114 which runs from the plug-in connector 108 to the plug-in connector 112 and which, as illustrated in FIG. 2, comprises the feed line 24*a* and the ground line 24*b*, which runs from the output stage 42 to the second fan motor 24 of the second fan 20.

The harness 106 also comprises a supply line 116, which runs from the plug-in connector 110 to the plug-in connector 108 and, as illustrated in FIG. 2, has a feed line 48*a* leading from a first supply connection 49 to the feed connection 48, a ground line 50*a* leading from a second supply connection 51 to the ground connection 50, and an input line 58*a* leading from an external connection 59 to an input connection 58, the supply connections 49 and 51 and the external connection 59 being provided in the plug-in connector 110 and being capable of being connected to the connection provided for the fan installation.

Figure 6:
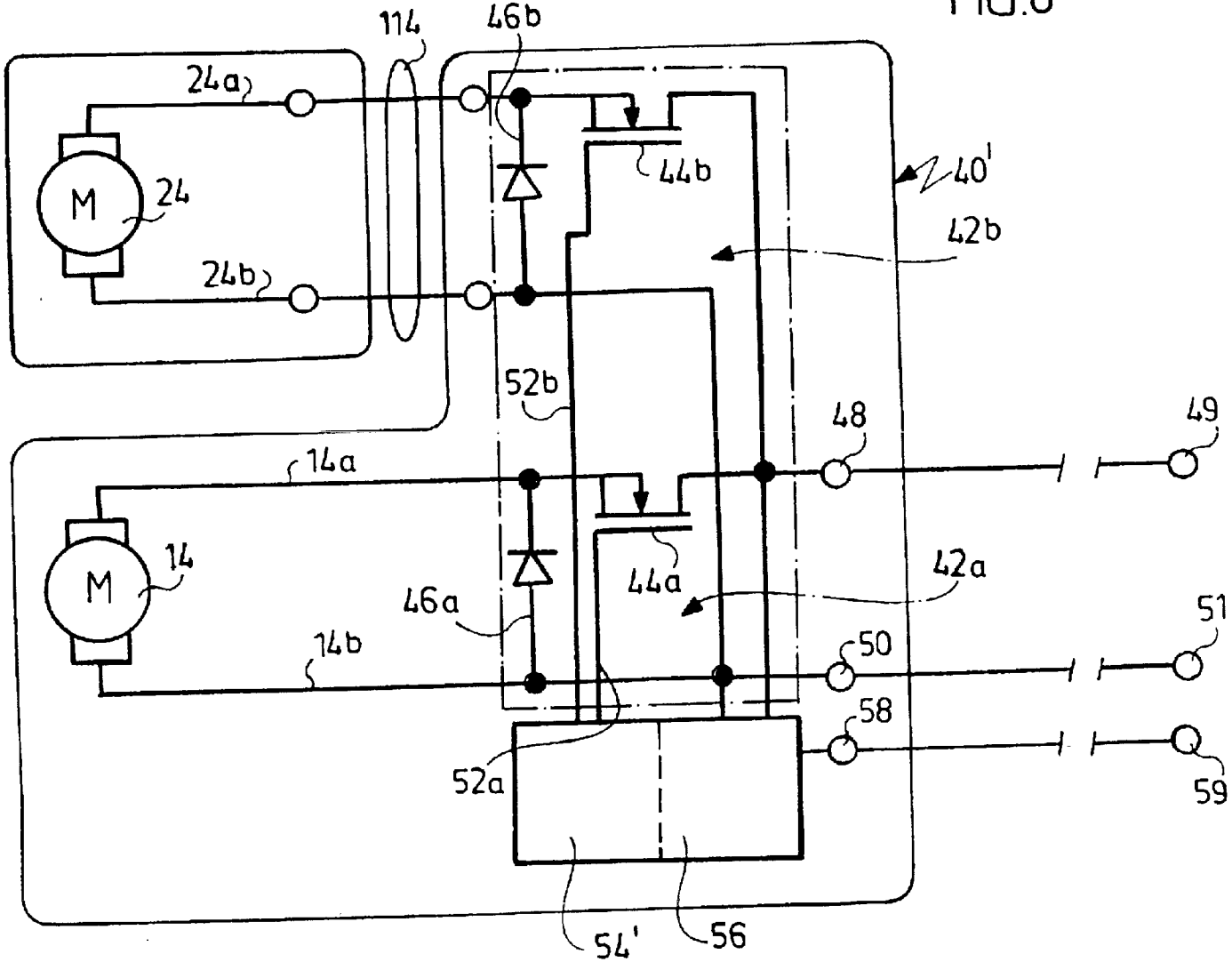
FIG. 6 shows an illustration similar to FIG. 2 of a circuit of the control unit of a second exemplary embodiment of a fan installation according to the invention.
Figure 7:
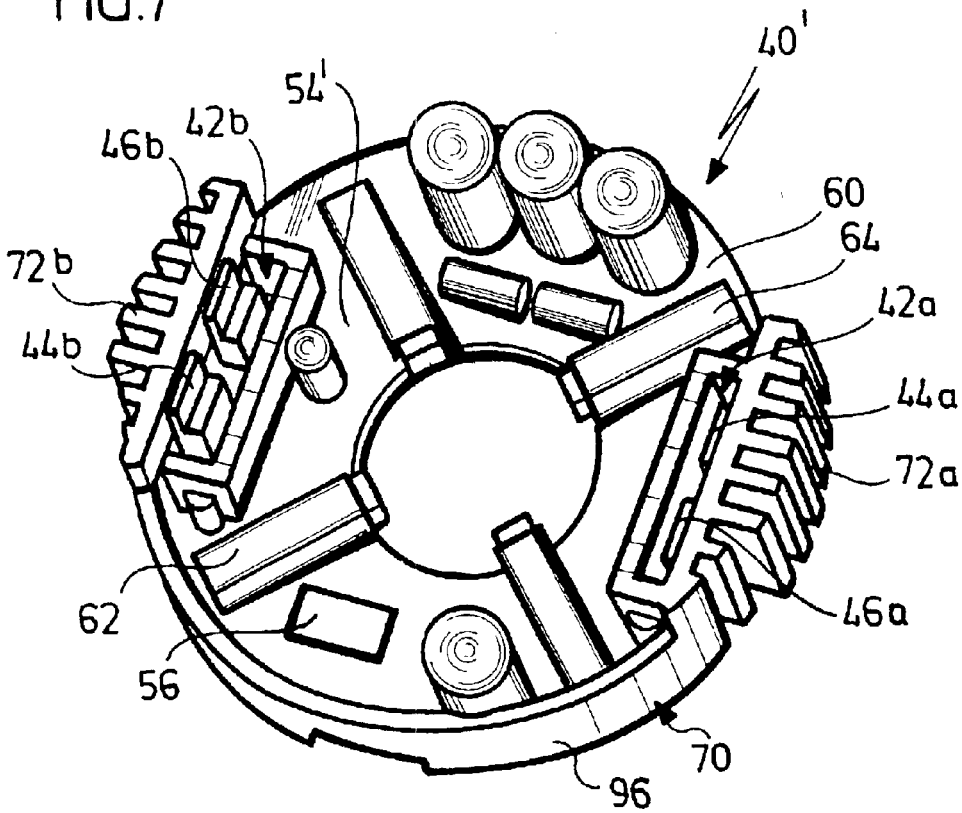
FIG. 7 shows an illustration similar to FIG. 3 of the control unit of the second exemplary embodiment of the fan installation according to the invention.
Figure 8:
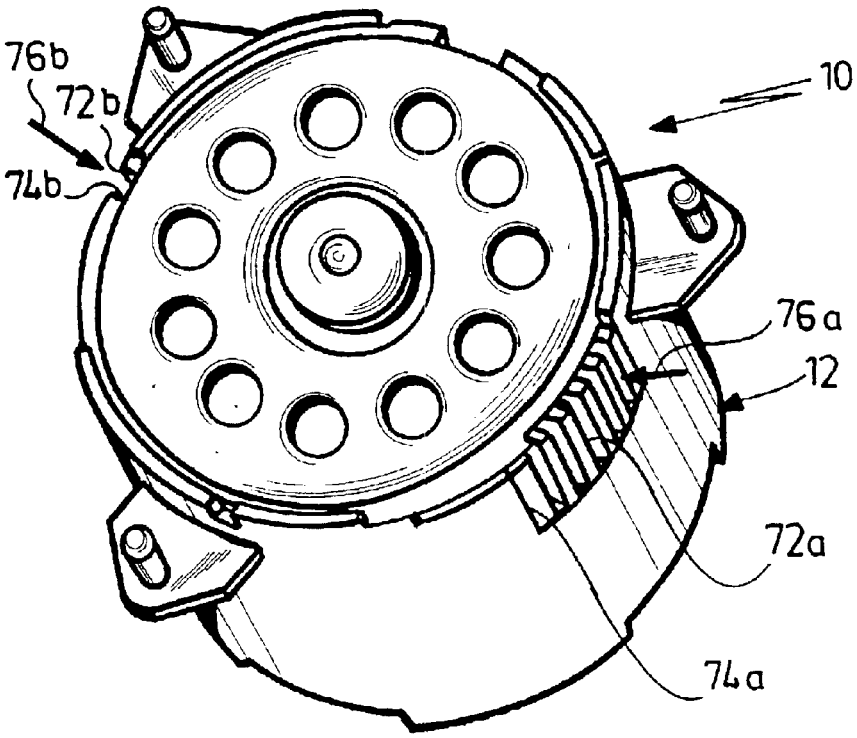
FIG. 8 shows an illustration similar to FIG. 4 of an external view of the housing of the fan provided with the control unit in the second exemplary embodiment of the fan installation according to the invention.

In a second exemplary embodiment of the fan installation according to the invention, illustrated in FIGS. 6 to 8, those elements which are associated with those of the first exemplary embodiment are provided with the same reference symbols so that, with regard to the description of the same, reference can be made to the entire content of the first exemplary embodiment.

As opposed to the first exemplary embodiment of the fan installation according to the invention, in the second exemplary embodiment of the fan installation according to the invention the control unit 40' is provided with a first output stage 42*a* for the first fan motor 14 and a second output stage 42*b* for the second fan motor 24, each of the output stages having an electronic switch 44*a* and 44*b*, respectively, and a freewheeling diode 46*a* and 46*b*, respectively, which operate in the same way as described in connection with the first exemplary embodiment.

Via the control lines 52*a* and 52*b*, the electronic switches 44*a* and 44*b* can each be driven with a pulse-width-modulated signal by the common control unit 54'.

However, in the second exemplary embodiment of the fan installation according to the invention, the feed line 14*a* and the ground line 14*b* lead to the first output stage 42*a*, and the feed line 24*a* and the ground line 24*b* lead to the second output stage 42*b* and are therefore driven separately from each other by the electronic switches 44*a* and 44*b* respectively provided for the fan motors 14 and 24.

Nevertheless, in the second exemplary embodiment of the fan installation according to the invention, the entire control unit 40' is also disposed in the first housing 12 of the first fan 10.

However, in this case, the heat sink 70' is respectively provided with a ribbed heat sink 72*a* and 72*b* preferably on opposite sides of the circuit board 60, each ribbed heat sink 72*a, b* being associated with an output stage, specifically the output stage 42*a* and 42*b*, respectively, and being used in particular to cool the respective electronic switch 44*a* and 44*b* and the corresponding freewheeling diode 46*a* and 46*b*.

Furthermore, the drive unit 54 and the logic circuit 56 and also the current feeds 62 and 64 for the first fan motor 14 are also arranged on the circuit board 60.

The entire control unit 40 can then be inserted into the first housing 12 in such a way that the ribbed heat sinks 72*a, b* are respectively associated with air openings 74*a, b* and can be cooled by the air flow 76*a* and 76*b*, respectively, passing through these, said air flow for example entering the first housing 12 through the corresponding air openings 74*a* and 74*b* and, in the same way as described in connection with the first exemplary embodiment of the fan installation according to the invention, being forced through the fan pot 88 of the first fan wheel 16 so that cooling both of the control unit 40 and of the first fan motor 14 in the case of the first fan 10 are carried out in the same way as described in connection with the first exemplary embodiment of the first fan installation but modified to the extent that two air flows 76*a* and 76*b* enter the first housing 12 on opposite sides and then also flow through the first fan motor 14.

What is claimed is:

1. A fan installation for a cooling system of a motor vehicle, comprising:

at least two fans positioned in parallel, each fan having an associated electric fan motor disposed in a separate fan motor housing and a fan wheel which can be driven by said motor, a control unit for providing respective signals for operating the fan motors, said control unit being disposed in the fan motor housing of one of the fans and operating the fan motor of each fan; and a fan assembly housing for the at least two fans.

2. The fan installation as claimed in claim 1, wherein the fan installation comprises a harness which can be connected to the two fans and has a plug-in connection comprising a supply connection and an external connection.

3. The fan installation as claimed in claim 2, wherein the harness can be connected to each of the fans via a plug-in connection.

4. The fan installation as claimed in claim 2, wherein the harness comprises a connecting line branch which runs between the fans and which has a feed line path.

5. The fan installation as claimed in claim 4, wherein the connecting line branch has a ground line path.

6. The fan installation as claimed in claim 2, wherein the harness comprises a supply line branch which runs from the fan provided with the control unit to the plug-in connection and which has a feed line path and an input line path.

7. The fan installation as claimed in claim 6, wherein the supply line branch has a ground line path.

8. The fan installation as claimed in claim 6, wherein the supply line branch and a connecting line branch which runs between the fans form a coherent harness.

9. The fan installation as claimed in claim 1, wherein the control unit comprises a common output stage for the operation of all the fan motors.

10. The fan installation as claimed in claim 1, wherein the control unit comprises a dedicated output stage for the operation of each of the fan motors.

11. The fan installation as claimed in claim 1, wherein the control unit is thermally coupled with a heat sink.

12. The fan installation as claimed in claim 11, wherein an output stage of the control unit is thermally coupled with the heat sink.

13. The fan installation as claimed in claim 11, wherein the heat sink is air-cooled.

14. The fan installation as claimed in claim 13, wherein the heat sink has at least one ribbed heat sink.

15. The fan installation as claimed in claim 10, wherein each of the output stages is coupled with its own ribbed heat sink.

16. The fan installation as claimed in claim 11, wherein an air flow that can be produced by the fan wheel flows through the housing of the fan which is provided with the control unit, and the air flow flows against the heat sink.

17. The fan installation as claimed in claim 16, wherein the heat sink is arranged in the region of an air opening of the housing, through which opening the air flow passes.

18. The fan installation as claimed in claim 1, wherein the control unit has a circuit board which extends in a plane which runs transversely with respect to the axis of rotation of the fan motor.

19. The fan installation as claimed in claim 18, wherein the circuit board bears current feeds for a commutator of the fan motor.

20. The fan installation as claimed in claim 19, wherein the current feeds have carbon brush holders arranged on the circuit board and carbon brushes which can be moved with respect to said holders.

21. The fan installation as claimed in claim 19, wherein the current feeds are thermally coupled with a heat sink.

* * * * *